US005261812A

United States Patent [19]

Javet, deceased et al.

[11] Patent Number: 5,261,812

[45] Date of Patent: Nov. 16, 1993

[54] CATALYSIS HEATING APPARATUS FOR GASEOUS FUEL

[75] Inventors: Alain Javet, deceased, late of Petit-Lacy, Switzerland; Michèle Javet, legal representative, Berlin; Claudio Javet, legal representative, Heppenheim, both of Fed. Rep. of Germany

[73] Assignee: Radiamon S.A., Switzerland

[21] Appl. No.: 634,209

[22] PCT Filed: May 23, 1990

[86] PCT No.: PCT/CH90/00134

§ 371 Date: Jan. 22, 1991

§ 102(e) Date: Jan. 22, 1991

[87] PCT Pub. No.: WO90/14557

PCT Pub. Date: Nov. 29, 1990

[30] Foreign Application Priority Data

May 23, 1989 [CH] Switzerland ..... 01930/89

[51] Int. Cl.[5] ..... F23D 14/12

[52] U.S. Cl. ..... 431/328; 126/92 R; 126/92 B

[58] Field of Search ..... 126/92 R, 92 A, 92 B, 126/92 C; 431/328, 329, 351, 352

[56] References Cited

U.S. PATENT DOCUMENTS

| | | | |
|---|---|---|---|
| 3,237,679 | 3/1966 | Best | 126/92 R |
| 3,359,965 | 12/1967 | Milligan | 126/92 R |
| 3,805,763 | 4/1974 | Cowan | 126/92 B |
| 4,189,297 | 2/1980 | Bratko et al. | 431/328 |
| 4,634,373 | 1/1987 | Rattner | 431/328 |
| 4,666,400 | 5/1987 | Vigneau | 431/328 |

FOREIGN PATENT DOCUMENTS

| | | |
|---|---|---|
| 1187339 | 2/1965 | Fed. Rep. of Germany . |
| 1304454 | 8/1962 | France . |
| 2273998 | 1/1976 | France . |

OTHER PUBLICATIONS

Patent Abstracts of Japan, vol. 9, No. 98 (M-375) (1821), Apr. 27, 1985-JP 59221508.

*Primary Examiner*—James C. Yeung

*Attorney, Agent, or Firm*—Cushman, Darby & Cushman

[57] ABSTRACT

A catalysis heating apparatus includes a catalytic combustion cell and a reflector made of two semi-circular sections which form the seat for a partition. Spacers create a gap between the combustion cell and the reflector and also accommodate an annular nozzle placed at one end of a channel. The partition center holds a ventilator which feeds air to said channel, while an electromagnetic valve controls the input of gas to the combustion cell. The assembly is held together by a section which comprises a grooved ring with an annular slot opening onto the inside, its two ends being fixed by rivets. A filtering compartment and a top are mounted on said grooved ring.

9 Claims, 1 Drawing Sheet

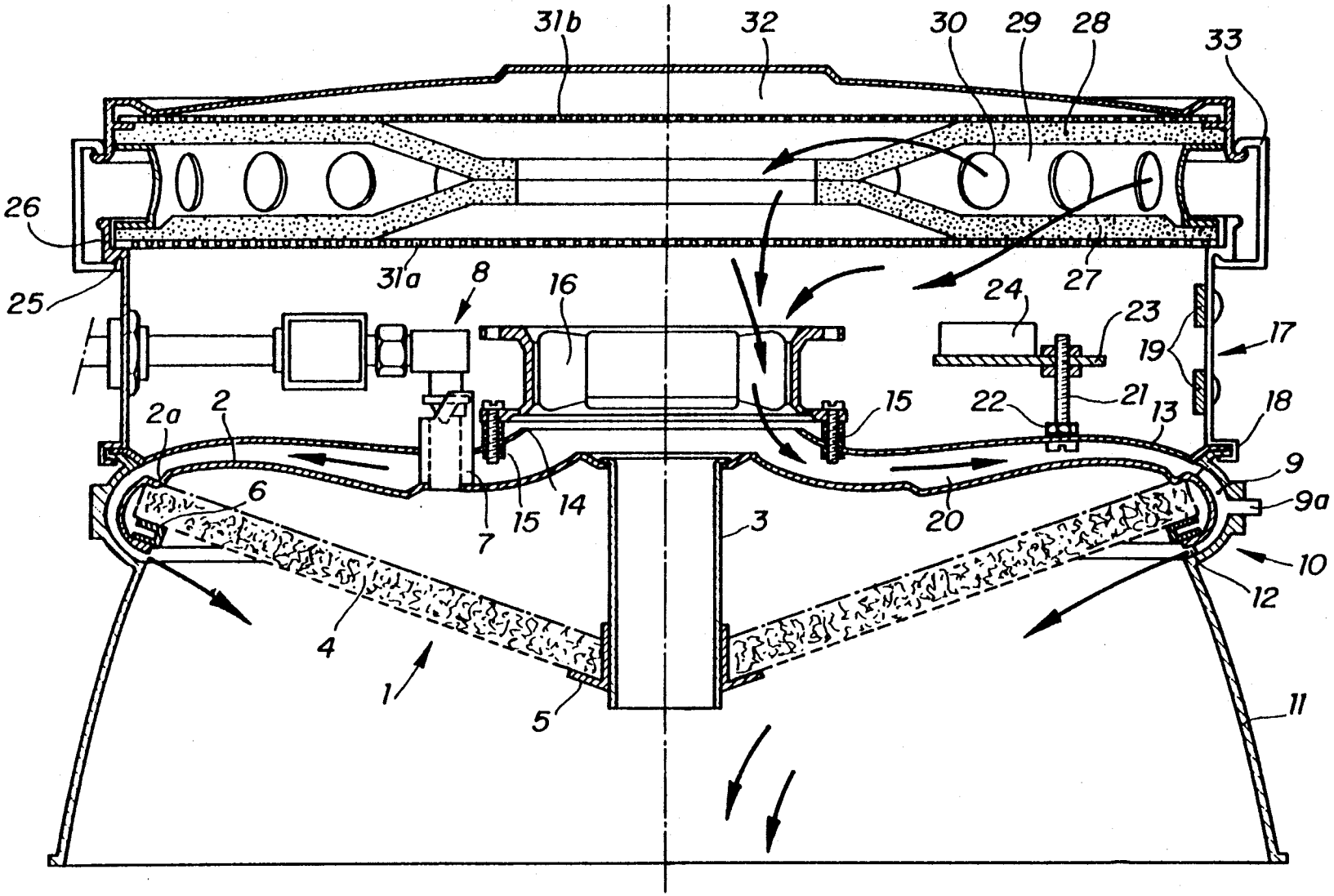
33
28
29
30
32
31b
26
25
17
19
23
24
27
18
9
9a
10
12
11
13
21
22
20
15
16
14
15
7
8
31a
2
2a
6
4
1
5
3

CATALYSIS HEATING APPARATUS FOR GASEOUS FUEL

BACKGROUND AND SUMMARY OF THE INVENTION

The present invention relates to a catalytic heater apparatus for gaseous fuel, including a combustion cell having a rear wall traversed by a supply conduit for fuel gas, and into which a front wall formed by a porous refractory substrate impregnated with an oxidation catalyst is fitted, with a reflector extending in front of this front wall, and an annular nozzle connected to a supply source of air surrounding its periphery.

The advantage of this type of apparatus over heaters that operate solely by radiation is that there is less stratification of the layers of air because of the forced mixing of the products of combustion with the ambient air. This mixing is made possible by the fact that the catalytic combustion temperature is on the order of 600° C. and is thus below the threshold beyond which carbon monoxide and $NO_x$ are produced, so that the combustion gases need not be evacuated as long as they do not contain toxic products. Nevertheless, the combination of convection heating with this type of catalytic burner requires the use of a valve and fresh air channels and distribution nozzles, to mix the fresh air with the hot combustion gases. The resultant apparatus is much more complicated in structure and thus more expensive to make.

The object of the present invention is specifically to make it possible to reduce the costs for machining the components of the apparatus and the costs for installing it.

To this end, the subject of the present invention is a catalytic heating apparatus for gaseous fuel including a combustion cell having a rear wall and a front wall connected together along respective peripheral edges and a supply conduit for fuel gas connected to the combustion cell through the rear wall. The front wall is a porous refractory substrate impregnated with an oxidation catalyst. A nozzle is defined adjacent to the peripheral edge of the porous refractory substrate and has two parallel lips extending in surrounding relation to and in front of the porous refractory substrate. The nozzle defines a substantially continuous opening directed toward a central axis of the combustion cell. A peripheral reflector projects in front of the porous refractory substrate from one of the lips. The peripheral reflector and the connected lip are provided by a same profile section element, with spacing braces positioning the profile section element around the cell. A seat is defined by a rear free edge of the profile section element and a partition member is provided which has a peripheral edge lying on the seat. A clamp engages the adjacent edges of the partition and the seat. A central opening is defined through the partition and a fan is fastened thereto. A channel is defined between the partition and the rear wall of the combustion cell to supply the nozzle with pressurized air from the fan.

The number of parts to be assembled have been reduced to a minimum, as has the number of fasteners. Moreover, the largest possible number of parts can be made from a profile section and, accordingly, require a minimum of machining operations. Consequently, the catalytic heating apparatus that is the subject of the invention can be made at a very competitive price, despite the elevated cost for the catalytic combustion cell, the porous refractory substrate of which is impregnated with platinum.

BRIEF DESCRIPTION OF THE DRAWING

FIG. 1 shows an embodiment of the catalytic heating apparatus of the present invention.

DETAILED DESCRIPTION OF THE PRESENTLY PREFERRED EXEMPLARY EMBODIMENT

The heating apparatus of the invention includes a combustion cell 1 including a rear circular wall 2 of drawn sheet aluminum, provided with a central tubular column 3. A porous refractory substrate 4, for example a layer of ceramic fibers impregnated with the substance acting as the oxidation catalyst, in this case platinum, is disposed around the central tubular column 3 and rests on a support grid retained by a ring 5 fastened onto the column. The periphery of substrate 4, which forms a cone, rests against an annular bearing **2*a* made in the rear wall 2. The substrate is pressed against the bearing 2*a* by a split ring 6 inserted between the curved-back edge of the wall 2 and the support grid. The rear wall 2 is then traversed by a conduit 7 that is connected to a source of fuel gas (not shown), such as propane, via an injector and an electric valve 8**.

By way of spacing braces 9, the cell is mounted between two semicircular parts made from two aluminum profile sections 10 bent round. The braces 9 each have a positioning pin **9*a* which is fitted into an opening of the profile section 10. As can be seen, these profiles form a reflector 11 that extends in front of the front wall of the combustion cell 1 formed by the refractory substrate 4 impregnated with the catalyst. Further, the edge of the reflector 11, which is adjacent to the remainder of the profile section 10, forms, with the curved-back edge of the rear wall 2 of the cell 1, an annular nozzle 12, the size of which is defined by the braces 9. To this end, the thickness of the braces decreases toward the annular nozzle 12** in order to increase the flow speed.

The free edge of the profile section. 10 forms a seat for a circular partition 13, the center of which includes an opening 14 surrounded by threaded tubes 15 for the fastening of a fan 16.

Another profile section 17, in the form of a split ring, has one edge in the form of an annular groove 18 open toward the inside, which receives both the free edge of the profile sections 10 and the free edge of the partition 13. The two ends of the profile section 17 are kept joined together by fastening rivets 19 that form a sort of shackle which holds the profile sections 10 and the partition 13 and cell 1 together with the aid of the spacing braces 9.

Once these parts are assembled, a closed channel 20 connects the annular nozzle 12 to the outlet of the fan 16. As can be seen, the cross section of this channel decreases progressively from the center to the periphery, in order to increase the speed of the air. A screw 21 is fixed with a nut 22 through the partition 13. Screw 21 carries a substrate 23 of the electronic control circuit 24 of the apparatus. Since the regulation of the apparatus is outside the scope of the present invention, the electronic circuit is not shown or described herein. The apparatus constructed as described above is functional; with a view to protecting the fan and regulating the thrust. However, an air filtering compartment has been provided as an option, above the supply and regulation compartment disposed inside the profile section 17.

To this end, the edge of the profile section 17 opposite the end serving as a fastening shackle, because of its annular groove 18, has a peripheral seat 25 that extends toward the outside and is encompassed by a rim 26. A filter is placed in this compartment and is formed of two annular filtering layers 27, 28 joined at their respective inside edges. Their outer edges are separated by a spacer ring 29 pierced with openings 30 for the passage of air. A circular grid 31*a* is placed on the annular seat 25, and the outer edge of the filtering layer 27 is caught between the inner edge of the spacer ring 29 and this grid 31*a*. The outer edge of the other filtering layer 28 is caught between the upper edge of the spacer ring and another circular grid 31*b* seated in a cap 32. Locking clips 33 serve to elastically fix the cap under the seat 25 of the profile section 17. This arrangement with a double filtering layer enables the passage of air upward and downward, thus increasing the filtration surface area and hence the service life of the filter. The air that passes along the lower layer also serves to cool the electronic and mechanical components located in the compartment located inside the profile section 17.

The fuel gas, which may or may not be directly mixed with the air, is introduced into the combustion cell 1 via the conduit 7. Prior to this, the refractory substrate 4, impregnated with the substance acting as an oxidation catalyst, is brought to a temperature sufficient for the catalytic reaction of the fuel gas to occur. To this end, an electric resistor, not shown, may be incorporated into the substrate 4 in order to heat it. Simultaneously, the fresh air aspirated by the fan 16 is passed via the annular nozzle 12 against the surface of the refractory substrate 4. This air can also serve the purposes of the catalytic reaction, in the event that the fuel gas was not mixed with the air beforehand. However, the air leaving the annular nozzle 12 serves primarily to mix with the hot combustion gases, for heating by convection, in addition to the radiant heating produced by the incandescent refractory substrate. This air already heats by circulating in the channel 20 and also serves to cool the rear face of the combustion cell and thus to protect the compartment located inside the profile section 17, which contains the regulation and control devices for the heating apparatus.

As can be seen, the set of elements comprising the apparatus is fixed with the aid of four rivets 19, holding the two lips of the split profile section ring 17 joined together, and the cap is retained by several clips 33 distributed over its circumference. The assembly of the apparatus is accordingly extremely simple, and the number of parts to be assembled is greatly reduced. Except for the rear wall 2 of the combustion cell 1, the partition 13 and the cap 32, all the other parts originate in extruded profile sections, including the braces 9. In this respect, it should also be noted that the braces 9 are cut to a thickness corresponding to the height of the positioning pin 9*a*, such that the pin has a cross section the diagonal of which is very slightly greater than the diameter of the hole machined into the profile section 10. With a simple blow of the hammer, the pin can be driven into this hole in the profile section 10 and thus maintained in the position desired. The only machining operations to be performed are the operations of cutting, piercing and bending round. It should also be noted that the entire rear wall 2 of the combustion cell is ventilated with fresh air, so that maximum heat is thus recovered and sent to the front of the apparatus, which is generally aimed downward.

I claim:

1. A catalytic heating apparatus for gaseous fuel comprising:

a combustion cell having a rear wall and a front wall connected together along respective peripheral edges, a supply conduit for fuel gas connected to said combustion cell through said rear wall, a porous refractory substrate impregnated with an oxidation catalyst and forming said front wall of combustion cell, a nozzle defined adjacent to the peripheral edge of said porous refractory substrate and having two parallel lips extending in surrounding relation to and in front of said porous refractory substrate, said nozzle defining a substantially continuous opening directed toward a central axis of said combustion cell, a peripheral reflector projecting in front of said porous refractory substrate from the one of said lips which is spaced from the peripheral edge of said porous substrate, said peripheral reflector and said connected lip being provided by a same profile section element, a seat being defined by a rear free edge of said profile section element, spacing braces to position said profile section element around said cell, a partition member having a peripheral edge lying on said seat, clamp means having an annular throat for engaging the adjacent edges of said partition and said seat, a central opening being defined through said partition, a fan fastened to said partition around said central opening, and a channel defined between said partition and the rear wall of said combustion cell to supply said nozzle with pressurized air from said fan.

2. The apparatus of claim 1, wherein the profile section element is in two parts, each extending over half the periphery of said cell and assembled via said clamp means.

3. The apparatus of claim 1, wherein said clamp means further comprises a wall disposed in surrounding relation to a space located behind said partition.

4. The apparatus of claim 3, wherein said wall ends in a peripheral seat extending radially outwardly and having a rim, said seat receiving a ring traversed with openings for supplying air and topped by a cap.

5. The apparatus of claim 4, wherein a filter is provided which is formed from two annular layers joined to one another around inner edges thereof, and outer edges thereof are caught between said peripheral seat and one edge of said ring, and between the other edge of this ring and the cap, respectively.

6. The apparatus of claim 5, wherein a grid is disposed between said seat and the other edge of said filtering layer.

7. The apparatus of claim 4, wherein the cap is fastened to the wall surrounding the space located behind said partition via locking tabs supported against the shoulder that said peripheral seat forms on the outside of that wall.

8. The apparatus of claim 1, wherein the rear face of said partition serves to support a unit for regulating the burner.

9. The apparatus of claim 1, wherein the spacing braces include a positioning pin having a cross section the diagonal of which is very slightly greater than the diameter of a hole machined in said profile section element for receiving said pin.

* * * * *